US005372520A

United States Patent [19]

Kilbey et al.

[11] Patent Number: 5,372,520

[45] Date of Patent: Dec. 13, 1994

[54] SHIELDED DATA CONNECTOR

[75] Inventors: Brian E. Kilbey, Chesham; Bruce S. Coolbear, East Barnet; Richard F. Gandy, St. Albans, all of England

[73] Assignee: The Whitaker Corporation, Wilmington, Del.

[21] Appl. No.: 20,488

[22] Filed: Feb. 22, 1993

[30] Foreign Application Priority Data

Feb. 24, 1992 [GB] United Kingdom ..... 9203888.4
Feb. 24, 1992 [GB] United Kingdom ..... 9203890.0

[51] Int. Cl.[5] ..... H01R 13/58

[52] U.S. Cl. ..... 439/460; 439/455; 439/466

[58] Field of Search ..... 339/407, 417, 455, 456, 339/459, 460

[56] References Cited

U.S. PATENT DOCUMENTS 4,224,465 9/1980 Ruzic ..... 439/459 X
4,722,580 2/1988 Kocher et al. ..... 439/466
4,986,779 1/1991 Ferrill et al. .

FOREIGN PATENT DOCUMENTS

0214660A3 3/1987 European Pat. Off. .
8126284 12/1983 Germany .
3103455C2 3/1984 Germany .

*Primary Examiner*—Eugene F. Desmond
*Attorney, Agent, or Firm*—Eric J. Groen; Driscoll A. Nina; Timothy J. Aberle

[57] ABSTRACT

An electrical shielded data connector includes an inner terminal support housing carrying a plurality of electrical terminals such as where the terminal support housing includes a shielded assembly surrounding the terminal support housing. The shielded sub-assembly is insertable into an outer housing and is latchably attached therein and a rear support plate and cable support member are barred by part tide in nature and can be assembled around the cable after the termination of the multi conductor cable. The cable clamp portion can be positioned in one of two orientations to provide for either a straight through or an angled cable exit.

21 Claims, 16 Drawing Sheets

SHIELDED DATA CONNECTOR

BACKGROUND OF THE INVENTION

1. Field of the Invention

The subject invention relates to an improved shielded data connector for use in local area network connections.

2. Description of the Prior Art

U.S. Pat. No. 4,501,459 discloses a local area network connector specifically for use in the data communications industry. These connectors can be employed in a closed loop data communications link fin which various equipment such as computer terminals can be interconnected in a system. These connectors are specifically adapted for use in interconnecting numerous micro or mini computers in a micro computer network in an office environment. Connectors of this type have standard interface dimensions and configurations. These connectors must also be shielded to prevent the spurious electrical signals and noise from affecting the signals in the network. These connectors also require a shunting capability since the conductors are part of a network and can be connected in series with other similar connectors. This shunting capability is necessary to prevent disruption of a network when an individual plug is not connected to external equipment.

The structure and components of local area network connectors of this type is represented by the structure of the connectors shown in the before mentioned U.S. Pat. No. 4,501,459. These connectors include a plurality of spring metal terminals having insulation displacement wire barrels for establishing electrical connection with the individual conductors forming the multi-conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to cover the upper and lower shields to the cable shielding.

There exists within the industry a need for a low cost local area network connector of this general type which can be easily hand assembled at the end user's facility. One such design is shown in PCT publication WO88/04841 and shows an inner insulative terminal retaining housing having upper and lower shields surrounding the housing where the shielded sub-assembly is insertable into a premoulded outer boot housing. The boot housing contains latching structure for mateable interconnection with a like connector in the data link. While the above mentioned PCT publication itself provides an enhanced low cost data connector assembly, this design also is not suitable for all data connection needs.

For instance, it is typical that the cable should have the possibility of exiting the electrical connector along a longitudinal line, straight out from the connector. The cable should also have the possibility of exiting at an angle, in applications where the cable drops to the floor or, where the connector is otherwise in a small clearance application.

Furthermore there are some applications where the outer housing should be slidably received over the inner housing after the termination of the electrical conductors to the electrical terminals and after the outer shield members are positioned in place on the shielded data cable. In the disclosure of the above mentioned PCT application, the pre-moulded boot must be inserted over the cable prior to assembling the individual data conductors to theft corresponding terminals in the terminal support housing.

There also exists a need for a local area network connector for this general type which can be easily hand assembled at the end user's facility, but can still meet or exceed present requirements for shielding and cross talk specifications. In the present designs, the connectors include so called stuffer caps which locate the individual wires and hold them in their lateral positions for presentation over the wire barrels of the electrical terminals. The wires which are used in such connectors are twisted pairs, and therefore the "untwisting" of the pairs must be kept to a minimum.

It is an object of the invention to provide for an electrical connector assembly where the outer housing can be inserted over the inner shielded sub assembly, after the termination of the wires to their corresponding electrical terminals.

It is a further object of the invention to provide a low cost shielded data connector where the assembly includes the possiblity of various cable exit angles, and in particular, where the alternate angled position does not require a redundancy of connector parts.

It is a further object of the invention to provide a low cost shielded data connector where the assembly includes adequate EMI/RFI and cross talk requirements.

SUMMARY OF THE INVENTION

The objects of the invention were accomplished by providing an electrical data connector for electrical connection to a data cable comprising an insulating terminal support platform having a plurality of side by side terminals disposed therein, said terminal support platform having an outer insulating housing at least partially surrounding said platform, said outer housing having latching mechanisms for latching said connector to a mating component. The connector is characterized in that said outer insulating housing has a rear opening as large as said terminal support platform and profiled for slidable receipt over a front mating face of said terminal support platform, and a cable support member slidable over said data cable and slidable relative to said outer insulative housing and snap latchable thereto, said cable support member including strain relief means for axially retaining said data cable.

In another aspect of the invention, an electrical data connector for electrical connection to data cable, comprises a plurality of electrical terminals positioned in the insulating housing, where the housing has at least one cable exit opening therethrough and a cable support sleeve fixable to the housing for retaining the data cable. The connector is characterized in that the cable support sleeve can be fixed in the cable exit opening in a plurality of orientations thereby providing a plurality of cable exiting directions.

In a further aspect of the invention, an electrical connector has an insulating housing carrying a plurality of electrical terminals, where the terminals include a contact portion and a wire termination portion, the wire termination portion comprising a slot within a metal plate member for insulation piercing electrical connection with the insulated wire, and a stuffer cap for receiving an insulated wire where the cap is insertable over the wire termination portion for electrically connecting the wire to the terminal. The connector is characterized in that the stuffer cap has a rear wall having a plurality of openings therethrough for receiving a plurality of wires to be terminated. The rear wall has angled surfaces facing a longitudinal center line of the connector whereby the wires are dressed in a angle towards the longitudinal center line.

DETAILED DESCRIPTION OF THE PREFERRED EMBODIMENT

Figure 1:
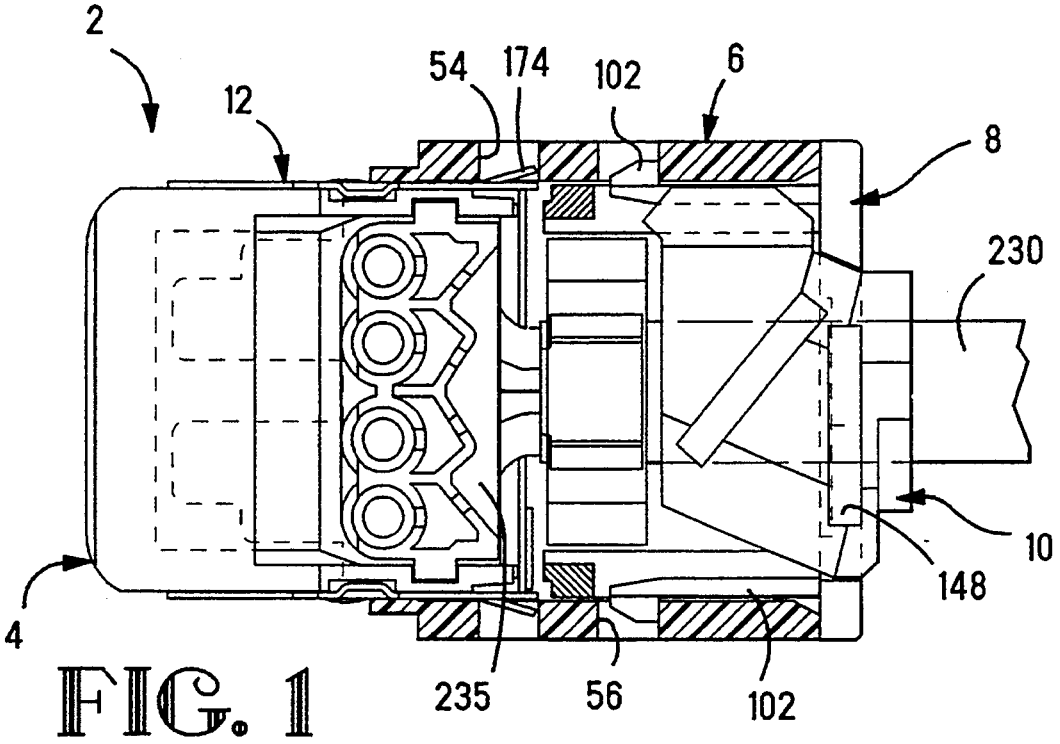
FIG. 1 is an upper plan view of the data connector of the present invention shown partially in section.

With reference first to FIG. 1, an electrical shielded data connector is shown generally at 2 and comprises an inner terminal support housing 4, an outer insulative housing 6, a rear support plate 8, a rear cable support sleeve 10 and a shield assembly shown generally as 12 to encompass the outer periphery of the inner insulative housing 4.

Figure 3:
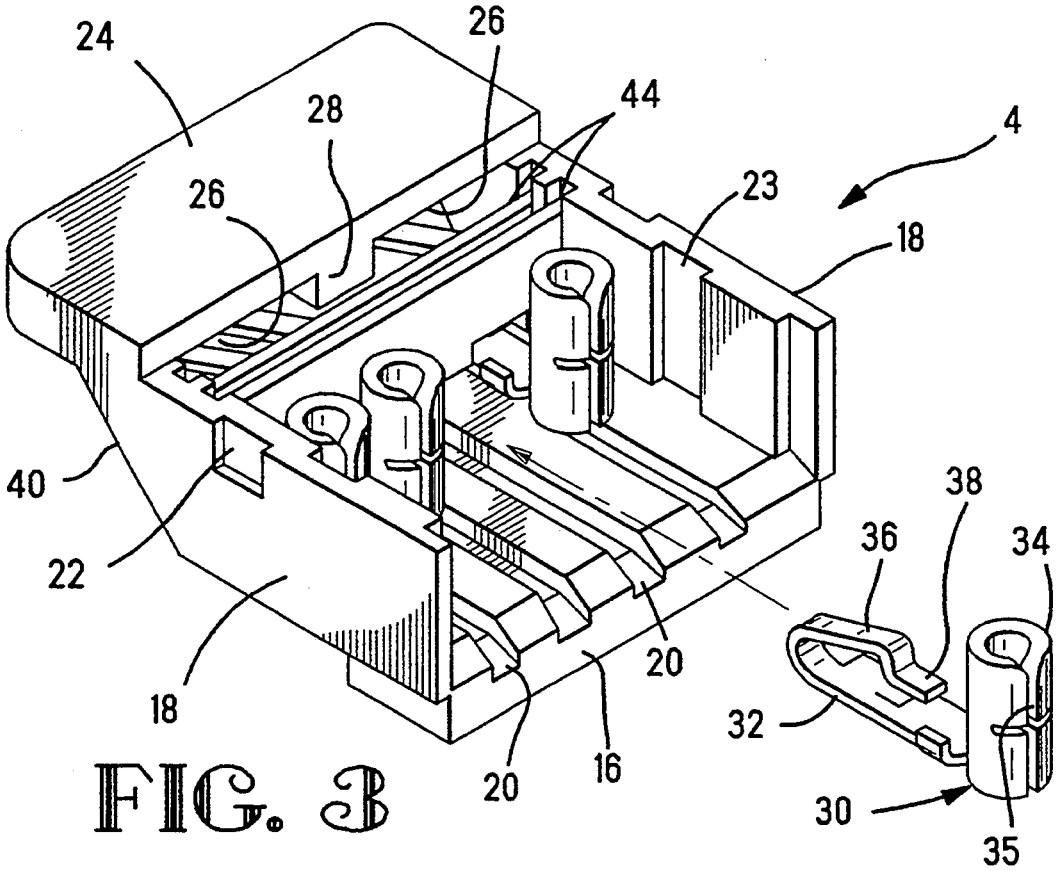
FIG. 3 is an isometric view of the inner terminal support housing showing one of the terminals exploded away from the terminal support housing.
Figure 4:
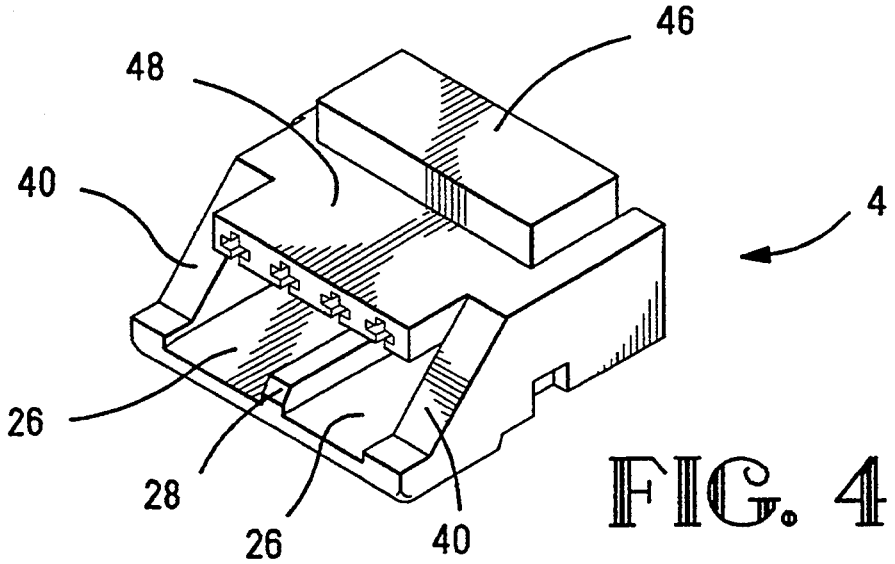
FIG. 4 is an isometric view of the terminal support housing in a rotated sense.

With reference now to FIG. 3, the inner insulative housing 4 is shown as comprising a terminal support platform portion 16 having upstanding side walls 18 where the terminal support platform L6 includes a plurality of terminal receiving slots shown generally at 20 and where the outer surfaces of the side walls 18 include notched portions shown generally at 22. A hood portion is shown generally at 24 spanning and interconnecting the two side walls 18 where the lower surface 26 of the hood portion 24 is interrupted by a longitudinally extending rib shown generally at 28 (FIGS. 3 and 4). Terminals are shown generally at 30 as comprising a base portion 32 having a wire barrel portion 34 extending from one end thereof and a contact portion 36 extending from the opposite end of the base portion 32, where the contact portion has a stepped portion extending from the free end thereof and shown generally at 38.

The terminal 30 is slidably receivable into a respective terminal receiving slot 20 as shown in FIG. 3 to a position where the contact portions 36 are adjacent to a front mating edge 40 of the terminal support housing 4, and positioned for mating interconnection with a complementary connector. The terminal support housing further includes two shunt bars 44 which span the electrical terminals 30 and selectively contact the stepped portions 38 of alternate terminals to provide a closed loop electrical connection as is more fully disclosed in U.S. Pat. No. 4,501,459. As shown in FIG. 4, the terminal support housing 4 further includes a lower insulative block portion 46 positioned on a lower surface 48 of the terminal support housing.

Figure 5:
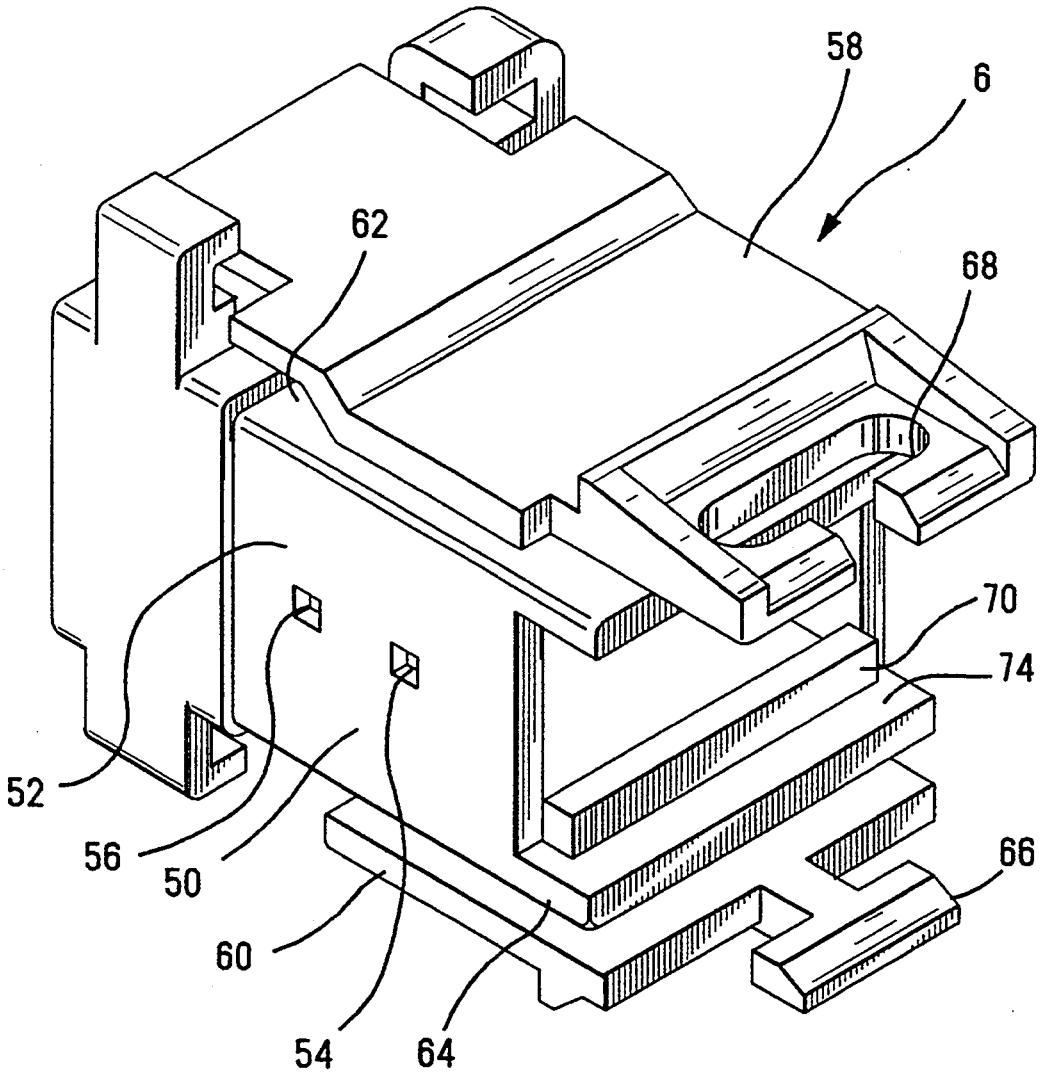
FIG. 5 is an isometric view of the outer insulative housing.

With respect now to FIG. 5, the outer insulative housing is shown at 6 and will described in greater detail herein. The housing 6 is comprised of a central body portion shown generally at 50 which in the preferred embodiment is rectangular in longitudinal cross-section to comprise side walls 52 containing a forward and rearward window 54, 56 respectively, extending through the side wall 52 on each side thereof. The housing 6 further includes upper and lower latching arms 58 and 60 which in the preferred embodiment of the connector are integrally connected to upper and lower surfaces 62, 64 respectively via integral webs of plastic material. The latching arms 58 and 60 include the standardized latching features commonly referred to as a T-bar such as 66 and a T-slot 68 whereby latching members 66 and 68 are hermaphroditically interconnectable with a like connector in the data link. As shown in FIG. 5, the housing 6 further includes an inner rib 70 spanning across an inner surface 74 of the connector housing 6.

Figure 6:
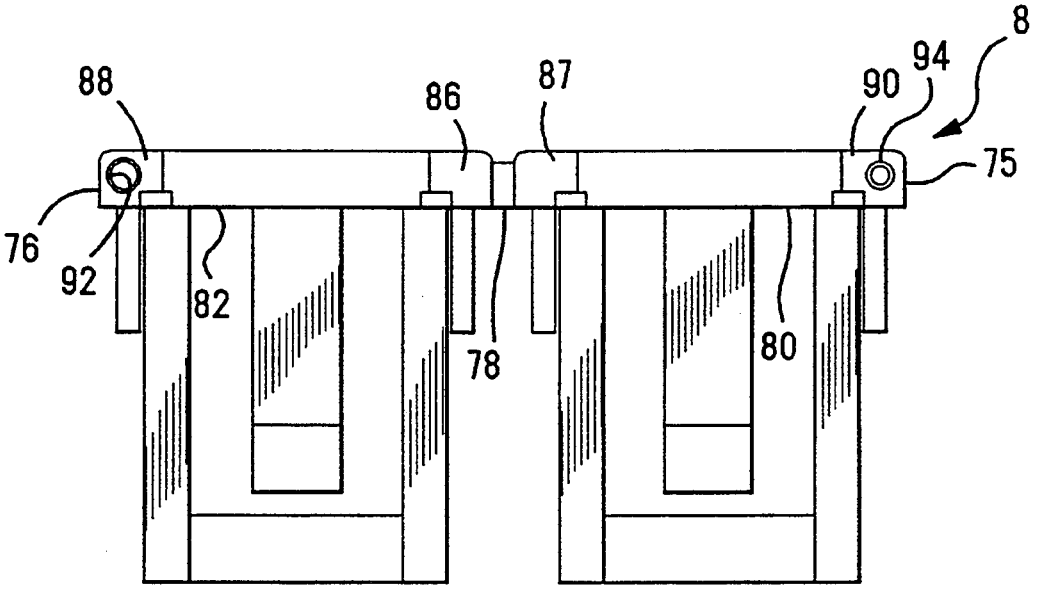
FIG. 6 is a plan view of the rear support plate in a preassembled position.
Figure 7:
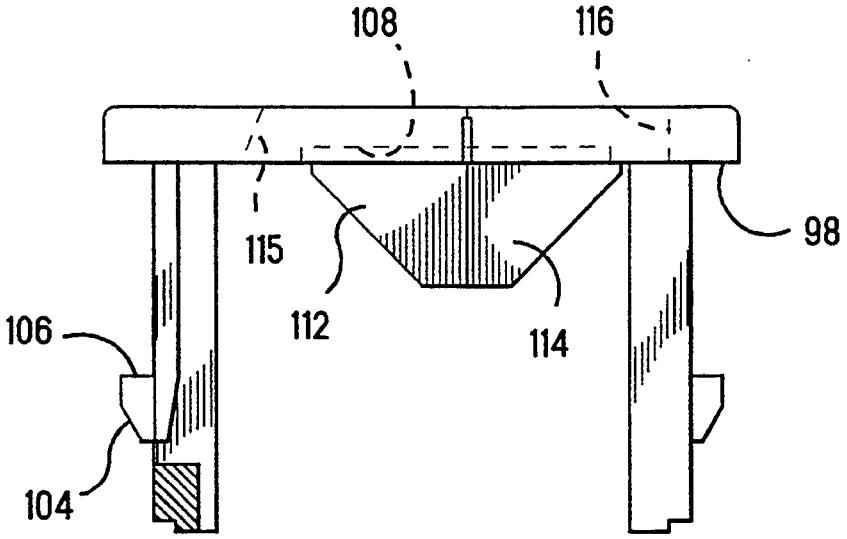
FIG. 7 is a view similar to that of FIG. 6 showing the rear support plate in a folded over condition.
Figure 8:
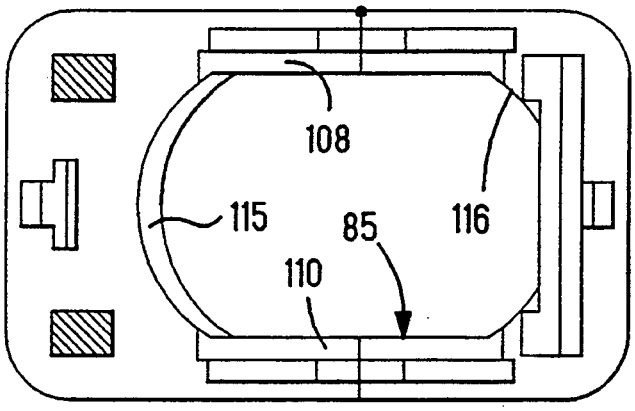
FIG. 8 is a rear plan view of the rear support plate shown in FIG. 7.

With respect now to FIGS. 6 to 9 the rear support plate 8 will be described in greater detail. The rear support plate 8 includes two support halves 75 and 76 where the halves are integrally moulded to one another via a central web of material shown at 78. As shown in FIGS. 6 and 8, the support plate includes two portions 80 and 82 where the plate portions 80 and 82 are U-shaped, whereby the U-shaped members can be rotated relative to one another to form an oval shaped opening generally at 85 formed by the aligned U-shaped plate members, where surface 86 abuts surface 87, and where surface 88 abuts surface 90 as shown in FIGS. 6 and 8. In the preferred embodiment of the invention, surface 88 includes a pin receiving aperture 92 whereas the surface 90 includes a pin 94 for alignment within the aperture 92 when the two plate halves are in the position shown in FIG. 8.

Figure 9:
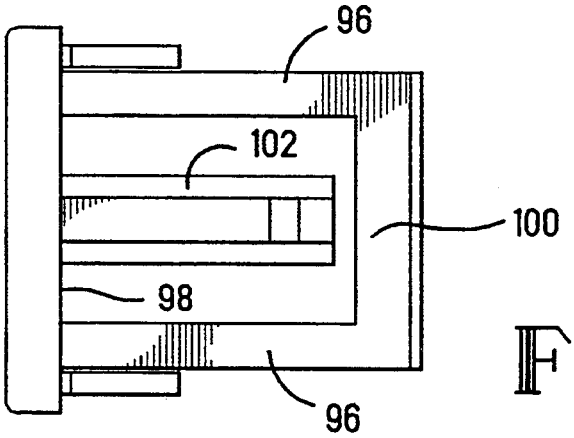
FIG. 9 is a side plan view of the support plate shown in FIG. 8.

Two support bars 96 extend from an inner surface 98 and a front leg portion 100 interconnects the two support members 96 on each side thereof as shown in FIG. 9. Each half 75 and 76 further includes a latching member 102 also extending from the inner surface 98 and includes a lead-in surface 104 and a lead-in locking shoulder 106, as shown in FIG. 7. Two recessed horizontal edges are shown at 108 and 110 in FIG. 8 also formed by the cooperating plate members 75 and 76. Two front plate members 112 and 114 also extend from the inner surface 98 formed by the two plate members 75 and 76 and surround the oval shaped opening at 85. The generally oval shaped opening 85 is shown in FIGS. 7 and 8 as having one angled surface shown best at 115 whereas the other surface 116 extends along a longitudinal arcuate path.

Figure 10:
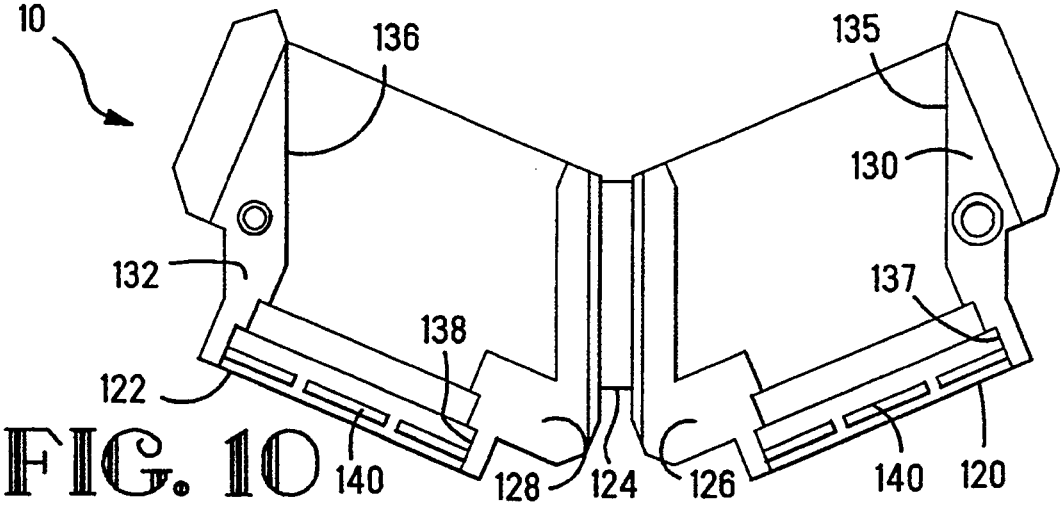
FIG. 10 is an inner plan view of the cable strain relief member prior to the assembly thereof.
Figure 11:
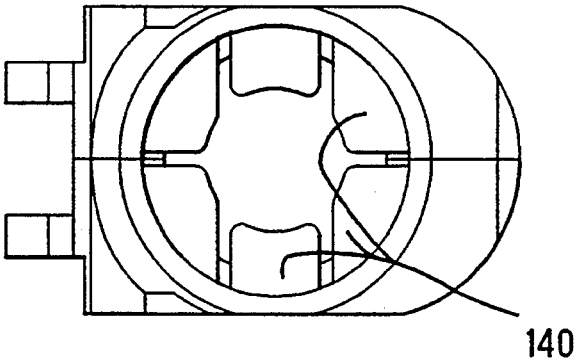
FIG. 11 is a front plan view of the cable support member of FIG. 10 shown in the folded over and assembled position.
Figure 12:
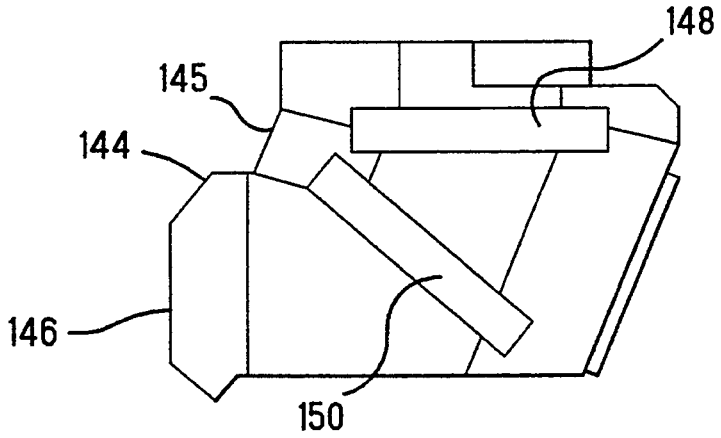
FIG. 12 is an outer plan view of the cable support member shown in FIG. 11.
Figure 13:
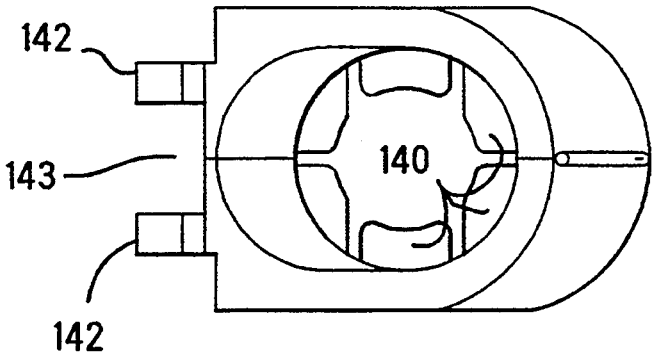
FIG. 13 is a rear plan view of the assembled cable support member of FIGS. 11 and 12.

With respect now to FIGS. 10–13, the cable support sleeve 10 is described in greater detail. The cable support member 10 is bipartite comprised of two halves shown at 120 and 122 in FIG. 10 where the two halves are integrally moulded via a central longitudinal web of material 4. The cable support halves 120 and 122 include surfaces 126 and 128, and 130 and 132 which cooperate to form abutting surfaces as shown in FIGS. 11 or 13. As shown in FIGS. 10 and 13, the cable support halves 120 and 122 include inner beveled surfaces 135 and 136 and generally semi-cylindrical surfaces 137 and 138 where the semi cylindrical surfaces contain collapsible membranes shown generally at 140 in FIGS. 10 and 13. The cable clamp halves 120 and 122 further include side locating ribs shown generally at 142 which are spaced apart and parallel to form an inner space 143 therebetween. As shown in FIG. 12, the ribs 142 include locating surfaces 144,145 and 146. As shown best in FIG. 12, the cable support halves 120 and 122 also include moulded slots 148 and 150 which will be described in greater detail herein.

Figure 14:
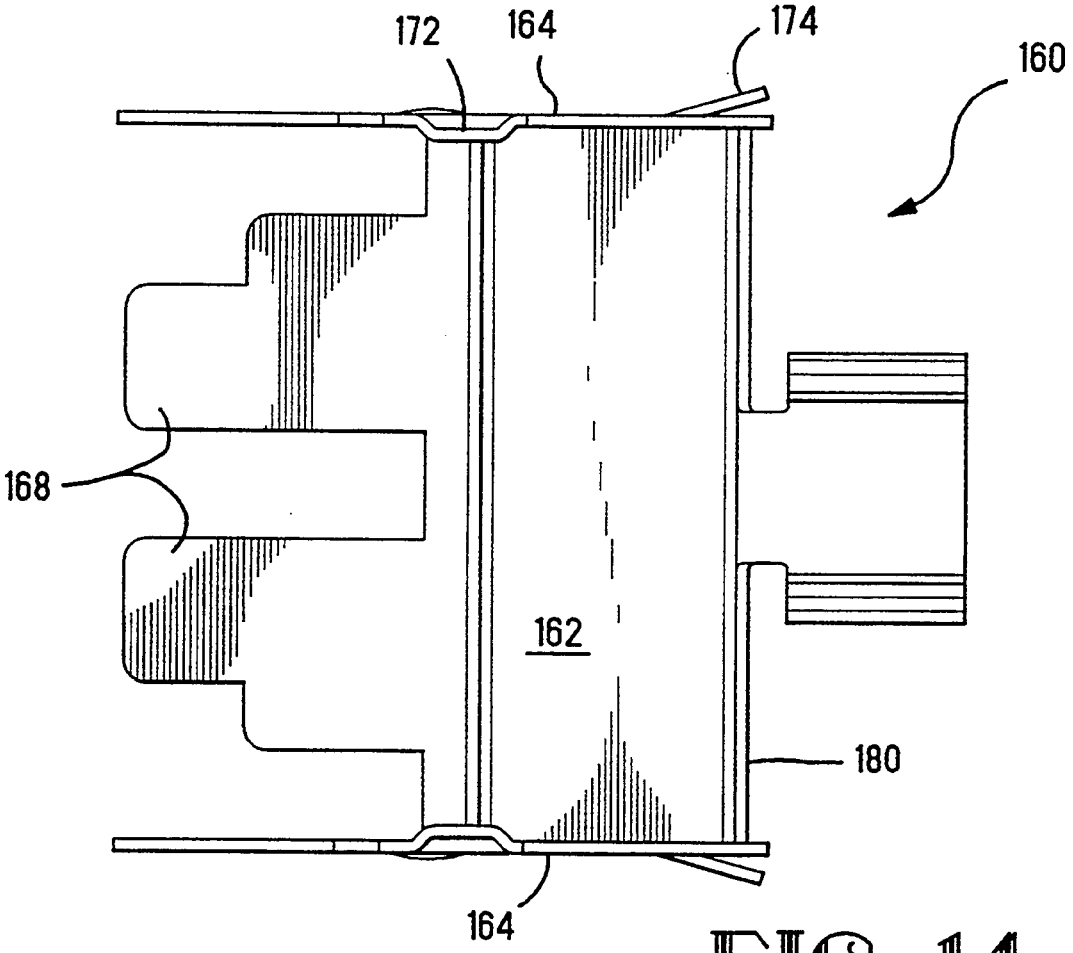
FIG. 14 is an upper plan view of the lower shield member.
Figure 16:
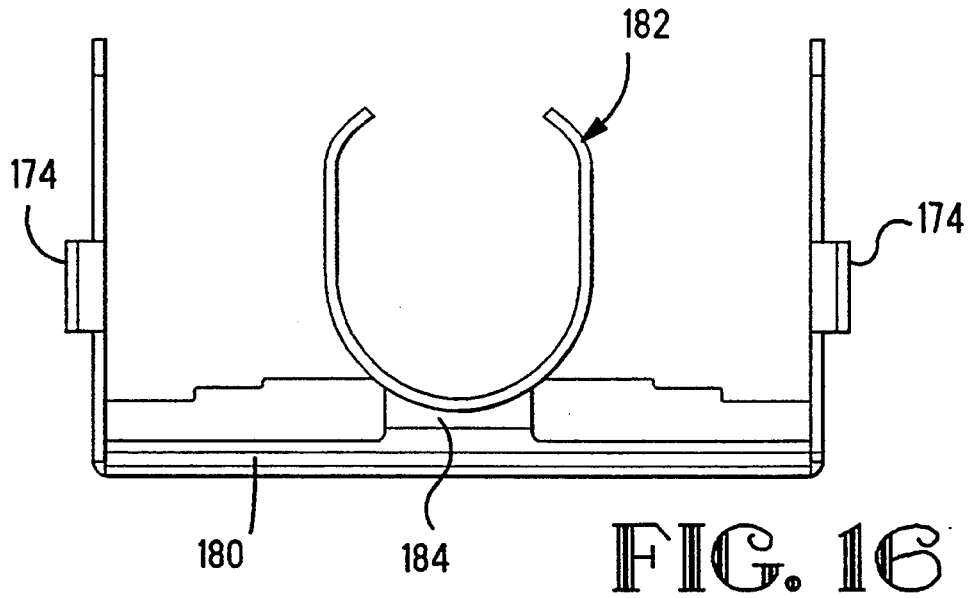
FIG. 16 is rear plan view of the lower shield member of FIG. 14.

With respect now to FIG. 14, the shield assembly 12 shown in FIG. 1 is comprised in part by a lower shield member 160 having a lower shield plate 162 and side plates 164. The lower plate 162 includes a stepped portion at 166 thereby forming a shield member for surrounding the lower block portion 46 (shown in FIG. 3) and includes two forward shielding wings 168 extending forwardly therefrom. Each side wall 164 includes an outwardly projecting dimple 170, an inwardly directed alignment deformation 172, rear locking lances 174, upstanding locking tabs 176 and stamped slot 178. As shown best in FIG. 16, a rear plate portion 180 is formed upwardly from the lower plate portion 162 and includes an integral cable receiving clamp 182 which is connected to the plate portion 180 via a stamped strapped portion 184.

Figure 17:
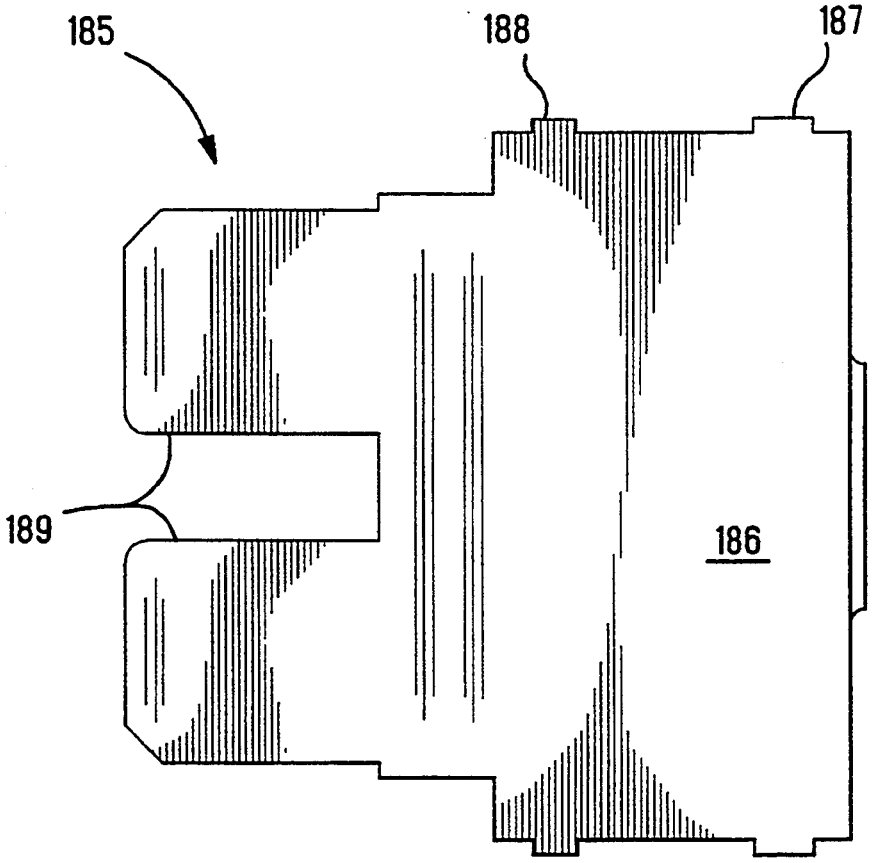
FIG. 17 is a top plan view of the upper shield member.
Figure 18:
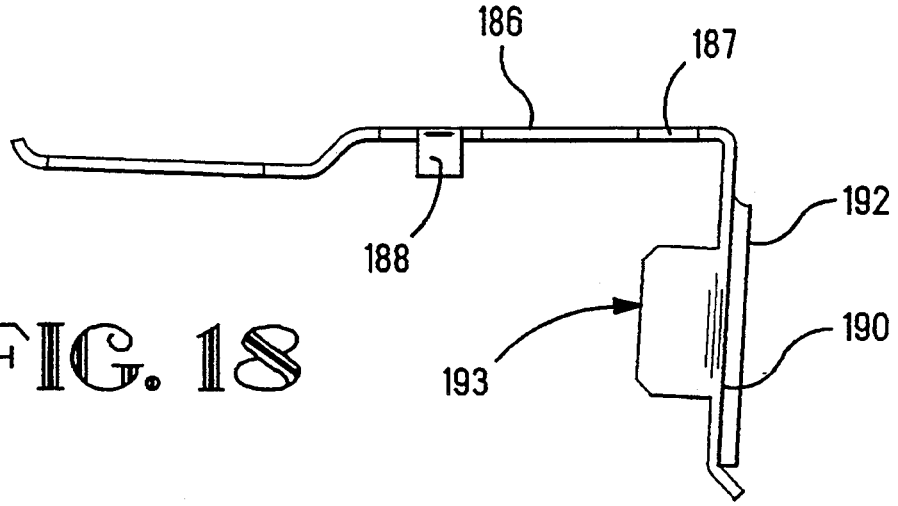
FIG. 18 is a side plan view of the upper shield member shown in FIG. 17.
Figure 19:
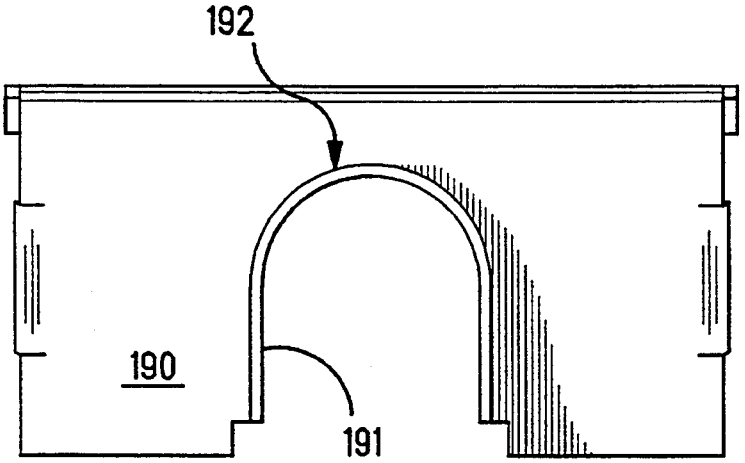
FIG. 19 is a rear plan view of the upper shield member shown in FIG. 17.

As shown in FIGS. 17–19, an upper shield member is shown at 185 as comprising an upper plate portion 186, having tabs 187 extending outwardly from each side edge, and tabs 188 extending downwardly therefrom. Two shielding wings 186 extend forwardly from the upper plate 186, and as best shown in FIG. 18, the wings 186 extend at a slight angle relative to the rear plate 186, as will be described in greater detail herein. The shield member 185 is also shown as including a rear plate portion 190, having a U-shaped opening at 191, formed by a curved shroud portion at 192. As shown in FIG. 18, the upper plate portion 186 is positioned at a slight angle relative to the rear plate portion 190. Two tabs 193 extend forward from the rear plate portion 190, and too, will be described in greater detail herein.

Figure 23:
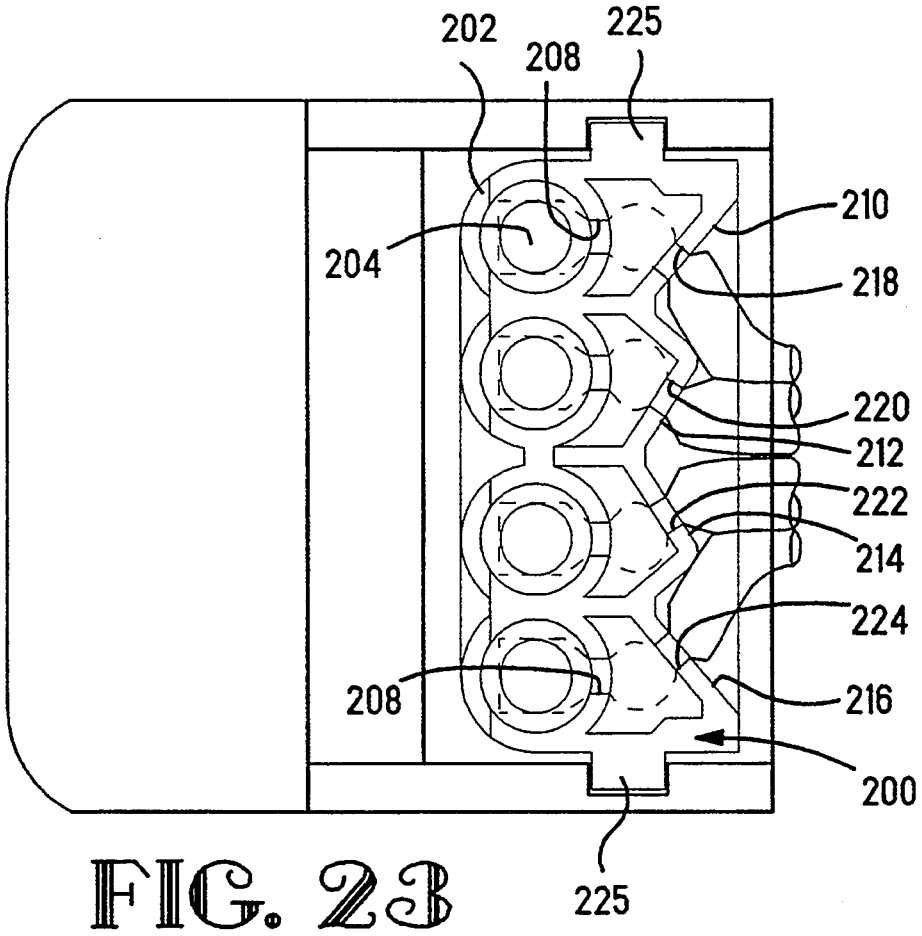
FIG. 23 is an upper plan view of the inner terminal support platform showing the insulated wires positioned in their terminated position.

With respect now no FIG. 23 the stuffer cap is shown generally at 200 as including an integral block of plastic having cylindrical plastic barrel portions 202 profiled to overlap the outer barrel portion 34 of the terminals 30 (shown in FIG. 3) and includes an inner peg portion 204 positioned part way down from an upper surface of the stuffer cap and co-axially aligned with portion 202. Each cylindrical portion 202 includes a rear wire exiting slot 208 formed through the cylindrical wall 202 to allow the wire to be inserted through the cylindrical portion and positioned against the free end of the peg 204. In the preferred embodiment of the invention, the stuffer cap further includes rear plate portions 210, 212, 214 and 216 where each of the plate portions 210–216 includes a wire receiving slot similar in nature to the slots 208, the slots being shown as 218–224. It should be appreciated that each or the plate portions 210–216 are generally directed towards a central longitudinal axis shown as L in FIG. 18. Upper cap 200 further includes aligning ribs 225 positioned on each side thereof which are profiled for receipt within the slots 23 on the inner side walls 38 of the housing 4 shown in FIG. 3.

Figure 2:
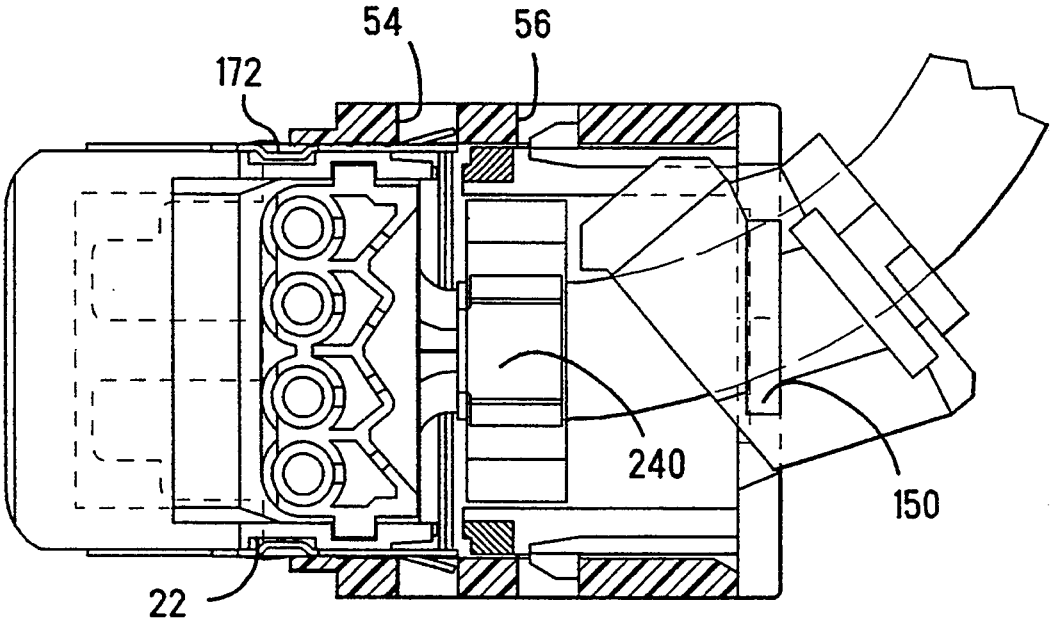
FIG. 2 is a view similar to that of FIG. 1 showing the data cable exiting through the rear of the connector at an angle.

With the individual components as above described, the assembly of the cable assembly including a shielded cable such as 230 shown in FIG. 1 will now be described. A shielded cable 230 generally includes an outer insulation surrounding an inner shielding braid where the shielding braid surrounds twisted pairs of data conductors, as shown in FIG. 1. A crimping clamp 240, shown in FIG. 2, is slid over the end of the data cable 230. The crimping clamp is similar to that shown in WO 88/04841. The electrical data connector assembly is assembled by first stripping a free end of the data cable 230 to expose shielding braid of the data cable 230. A portion of the shielding braid towards the free end thereof is later cut to expose the individual data conductors 235, and are positioned in associated slots such as 208 and 218 to position each conductor 235 into one of the insulative barrel members 202 and positioned against one of the pegs 204. Tile stuffer cap 200 can now be aligned with the housing member 4 such that the side ribs 225 are positioned in the side slots 23 which aligns the insulative barrel members 202 with corresponding barrel terminals 34 of the terminals 30. Pressing down on the stuffer cap positions the individual insulated conductors in the barrel slot 35 shown in FIG. 3.

The lower shield member 160 can now be positioned around the housing member 4 such that the deformations 172 are positioned in the side notches 22 in the side walls 18 and such that the integral clamp 182 surrounds the shielding braid of the shielded data connector. The clamp member 240 can now be slid forwardly to encompass the clamp 182 and can be crimped to provide an adequate electrical connection between the lower shield and the shielded braid of the sable. The upper shield part 185 is now assembled to the lower shield part by inserting the front wing members 189 (FIG. 17) into the housing member 4, below the hood portion 24, such that the wing members span the rib 28. As designed, with the plate portion 190, the upper shield portion 185 is sprung into place such that the tabs 187 are positioned into windows 178, and the top shield portion is spring loaded to the lower shield portion 160.

Figure 15:
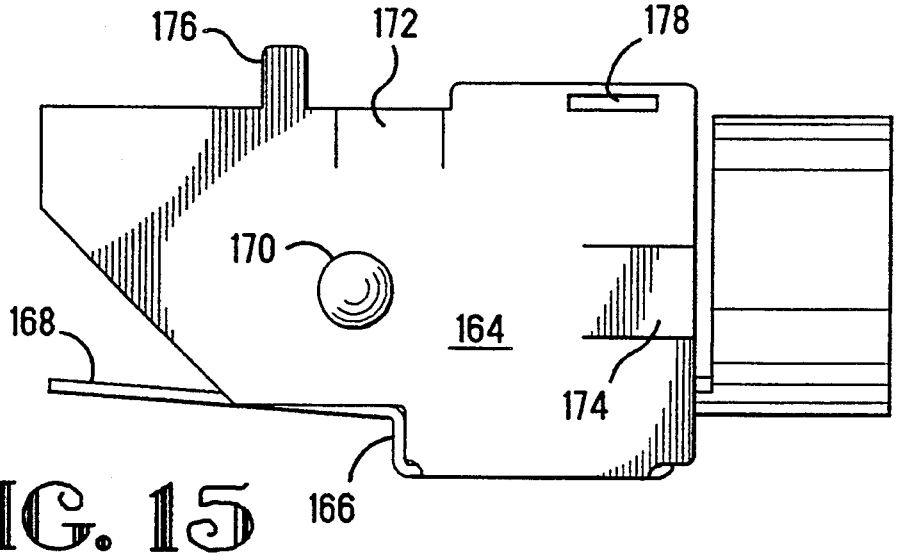
FIG. 15 is a side plan view of the shield member of FIG. 14.
Figure 20:
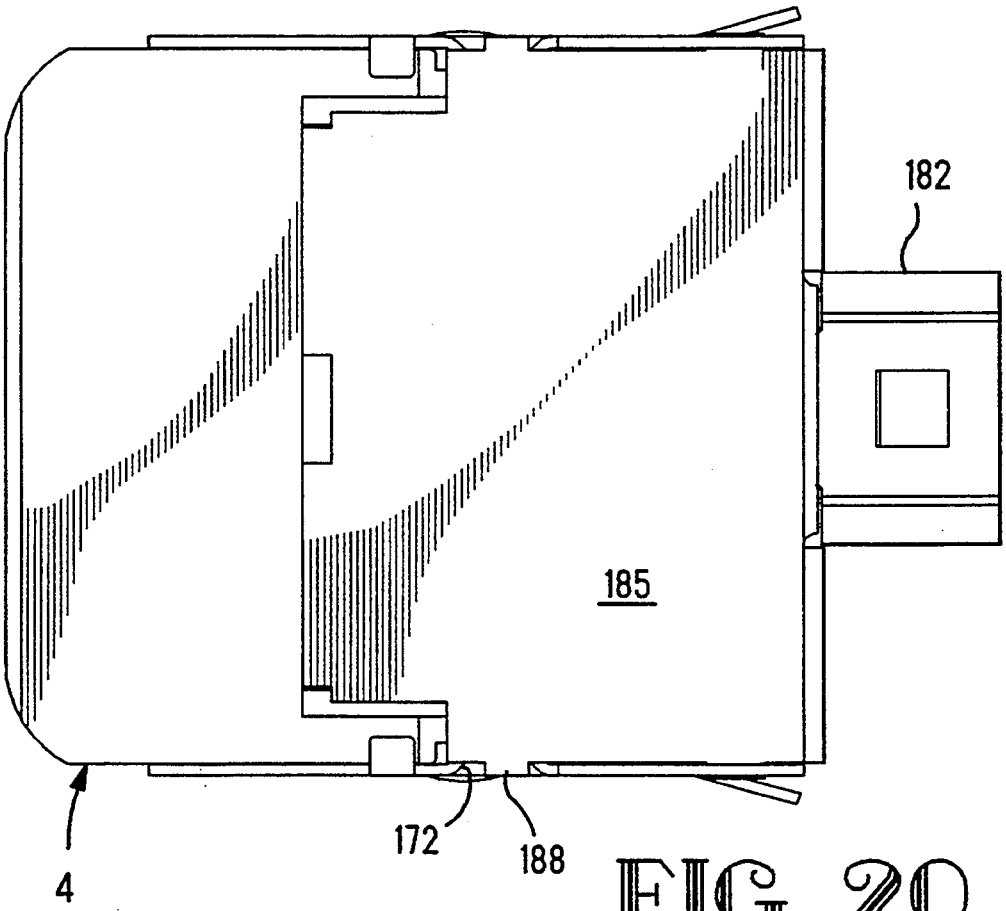
FIG. 20 is a top plan view of the upper and lower shield in an assembled position.
Figure 21:
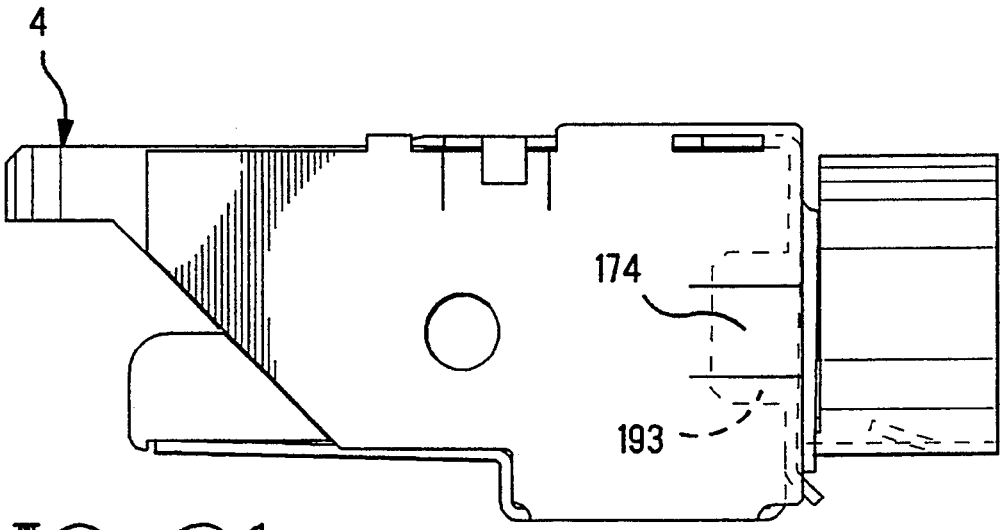
FIG. 21 is a side plan view of the assembled version shown in FIG. 20.
Figure 22:
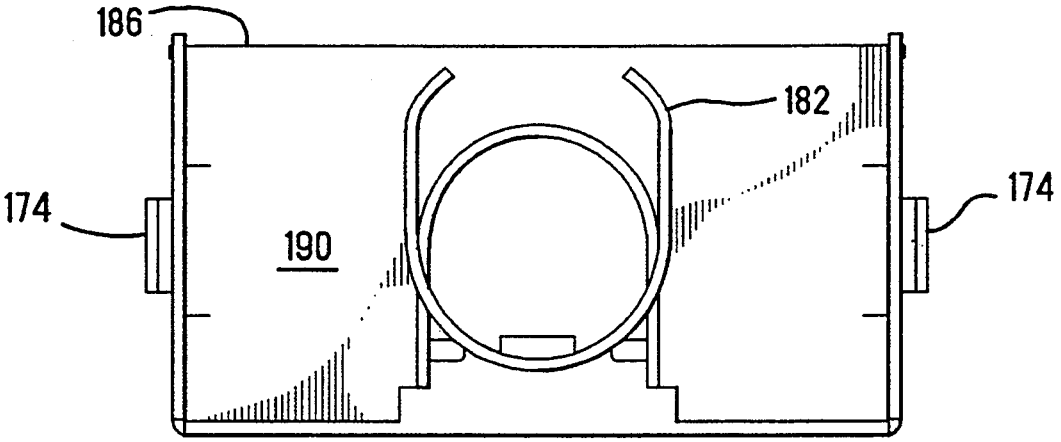
FIG. 22 is a rear plan view of the assembled version of FIGS. 20 and 21.

It should also be noted that as installed, the shield subassembly shown in FIGS. 20–22 contains no EMI/RFI "windows", as each hole or aperture created in the lower shield is covered by a tab portion in the upper shield. For example, the aperture 178, (FIG. 15) is filled by the tab 187 (FIG. 17), an the spaces formed by the tabs 174. It should also be honed that the inward deformation at 172 is positioned in the notch at 22, and the aligning tab 188 is situated in the deformation, which as shown in FIG. 20, does not increase the width of the overall assembly.

The outer housing member 6 can now be slidably received over the terminal support platform 4 from the front thereof until the lower block portion 46 together with the front edge 166 of the shield member 160 abut the rib 70 located adjacent to the front edge of the housing of the outer housing as shown in FIG. 5. At the position where the housing 6 is fully received over the terminals housing 4, the side locking lances 174 of the lower shield member of the lower shield member 160 are locked in place in the front window 54 of the outer housing member 6.

The installer can now decide whether the cable exits should be straight or angled, and the same cable support member as shown in FIGS. 10–13 can be used for either orientation. If the user desires a straight exit, the cable support sleeve 10 is positioned over the exterior of the data cable 230 to a position where the cable sleeve surrounds the cable, (to the configuration shown in either FIG. 11 or 13) and the cable support sleeve 10 is positioned within the rear plate such that slot 148 is positioned in recessed slot portions 108,110 as shown in FIG. 8. The rear plate is then fully positioned around the cable support member 10 shown in FIG. 8 and the rear support plate is pushed forwardly into the position shown in FIG. 1 where the latching arms 102 are latched within the windows at 56 in the outer housing portion 6.

If the user desires for an angled wire exit, the cable support member 10 is installed in the same manner as described above, except that the slot 150 is positioned between the recessed slots between 108 and 110 of the rear support member 8 and the rear support member is rotated by an angle of 180° as shown in FIG. 2. Thus as shown in the configuration of FIG. 2, the surfaces 135 and 136 form a relief angle around which the cable can bend. Thus as described in the above mentioned embodiment, the outer housing 6 can advantageously be slidably received over the shielded sub-assembly after the termination of the conductors and after installation of the shield assembly 12. This is due to the fact that the rear support plate 8 and the cable support member 10 are bipartite in nature and can surround the cable after the cable is installed to the housing 4. Also advantageously the rear cable sleeve 10 can provide for both straight through and angled cable exit without adding a redundant part to the connector assembly. Also advantageously the stuffer cap has plate portions which are generally directed towards a longitudinal axis of the connector assembly therefore the cable twist can extend closer to the electrical terminals thereby providing better cross talk characteristics to the connector assembly.

Figure 24:
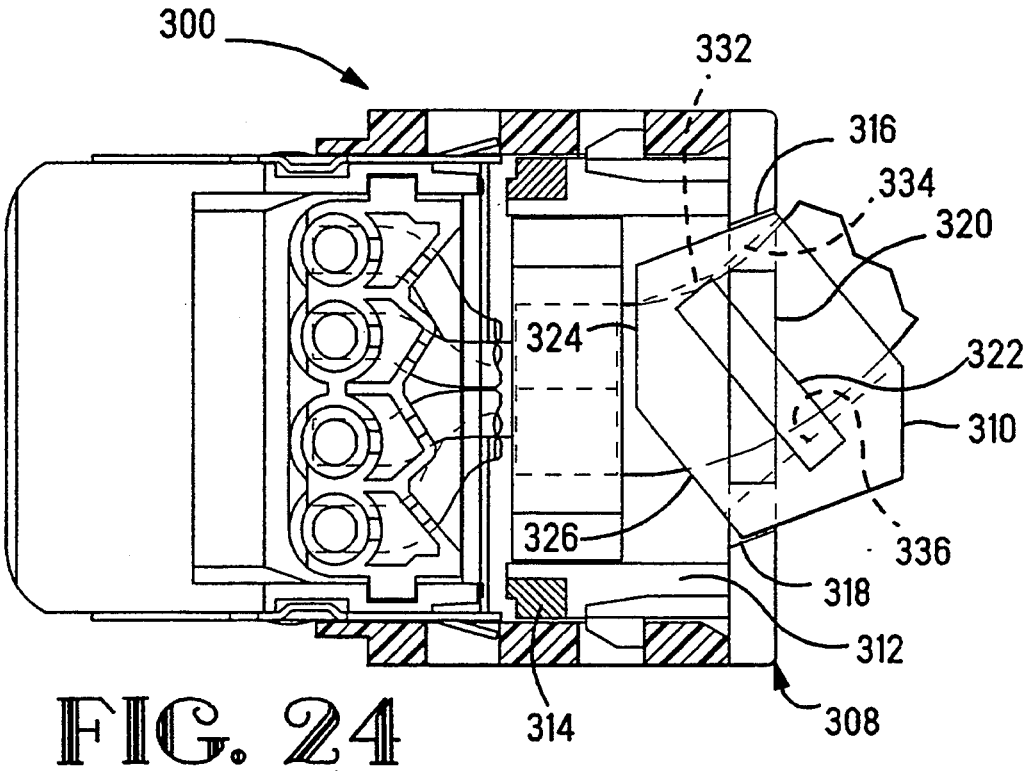
FIGS. 24 and 25 show a second embodiment of the data connector showing two angles of cable exit.
Figure 25:
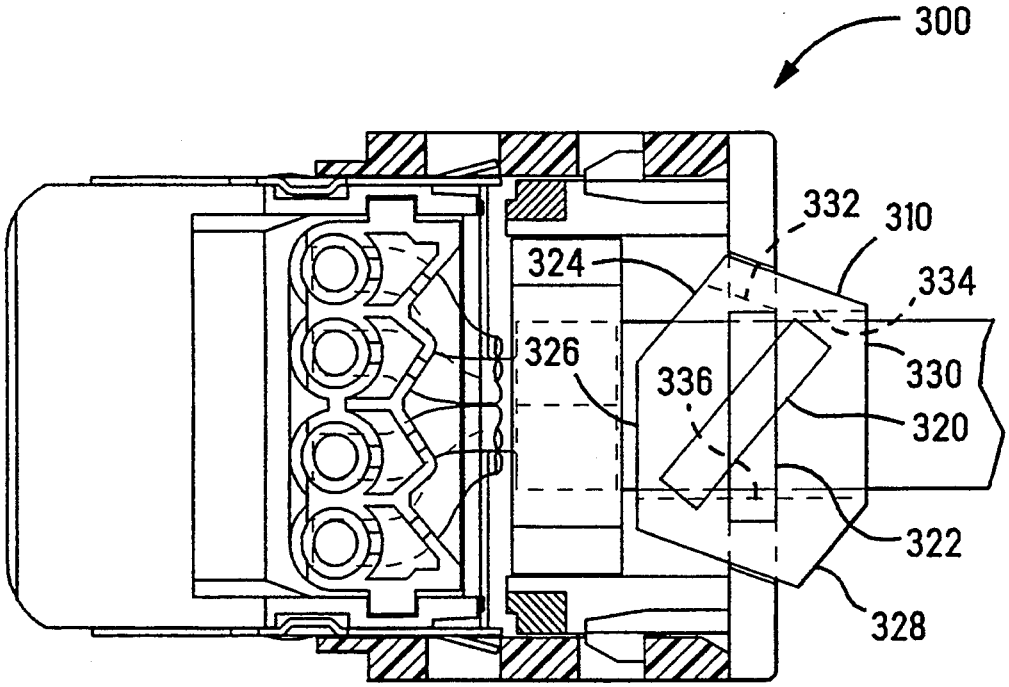

With reference now to FIGS. 24 and 25, a second embodiment of the connector is shown at 300 having a modified rear support plate 308 and a modified cable support sleeve 310, The support plate is similar to the previous support plate having legs 312 and posts 314 interconnecting the two legs 312 on each side. It should be appreciated that the rear support plate is also shorter in the longitudinal distance due to the modified cable sleeve 310. The cable support plate 308 also has two angled surfaces 316 and 318 for receiving the cable support sleeve.

The cable support sleeve 310 comprises bi-partite halves as the previous sleeve, but is substantially shorter. The sleeve 310 includes intersecting slots 320 and 322 which fit within edges in the bipartite halves as before. The sleeve 310 further comprises inner surfaces 324 and 236, and outer surfaces 328 and 330. Finally, the sleeve includes circumferential surfaces 332, 334 and 336.

If the user desires an angled out wire as shown in FIG. 24, the rear plate is positioned as shown, and the slot 320 is positioned in the edges of the bipartite cable shell halves, with surface 334 and 336. If the user desires a straight through cable exit, then the rear support plate is rotated to the position shown in FIG. 25, and the cable support shell 310 is rotated clockwise (as viewed in FIG. 25) to position slot 322 in the rear support plate 310, with surface 236 facing the shield clamp.

Figure 26:
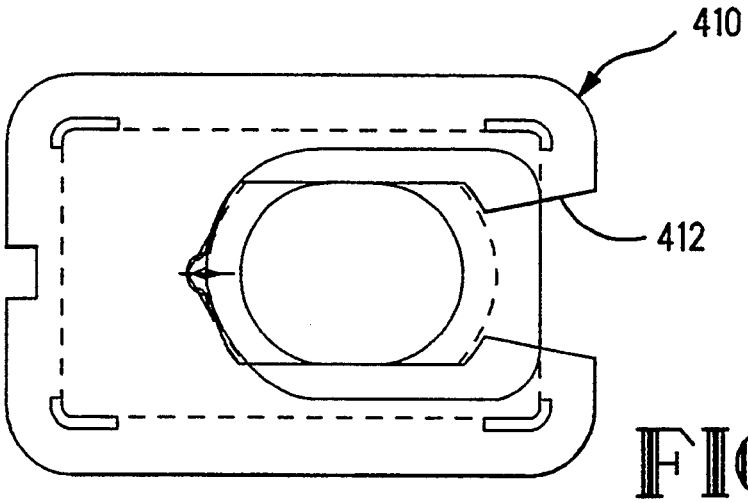
FIG. 26 shows a front plan view of a third embodiment of rear support plate.
Figure 27:
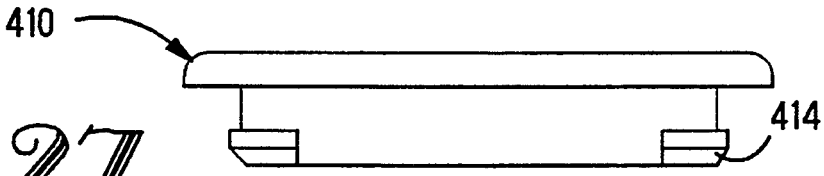
FIG. 27 shows a side view of the plate shown in FIG. 26.
Figure 28:
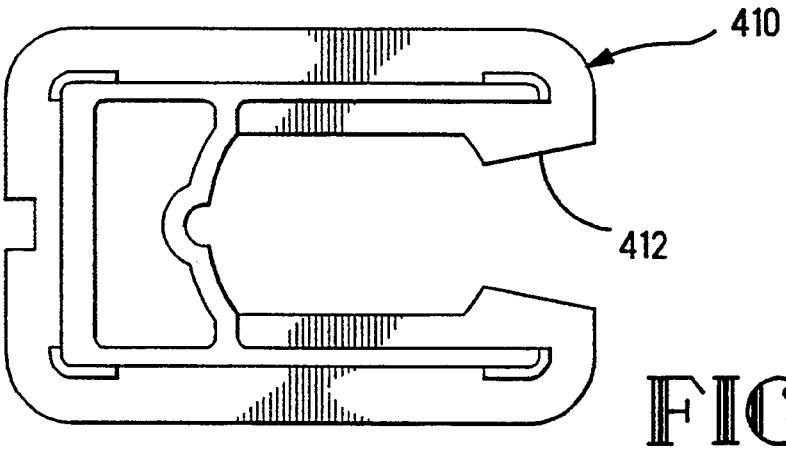
FIG. 28 shows a rear view of the plate of FIG. 26.
Figure 29:
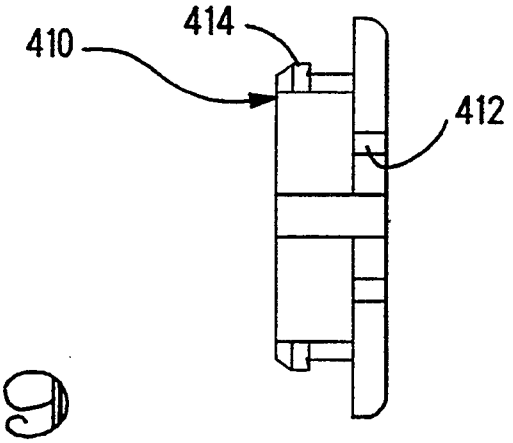
FIG. 29 shows an end view of the plate of FIG. 26.
Figure 30:
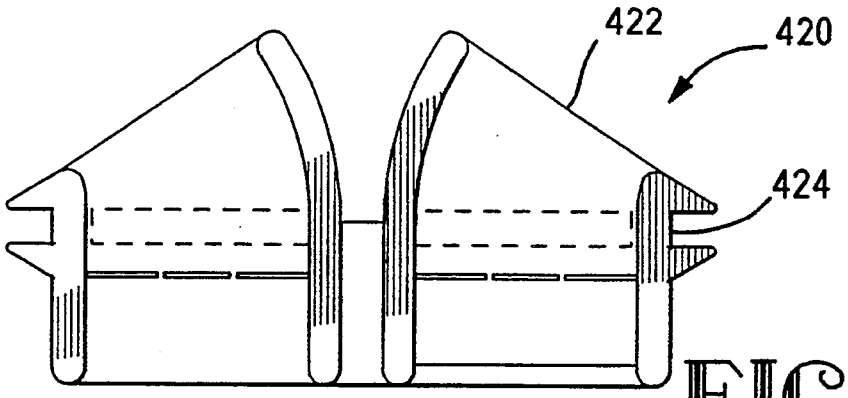
FIG. 30 shows a cable support member for use with the rear support plate of FIG. 26–29.
Figure 31:
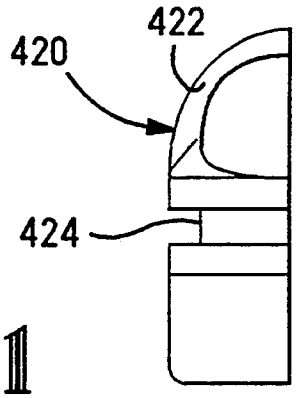
FIG. 31 shows an end view of the cable support member of FIG. 30.
Figure 32:
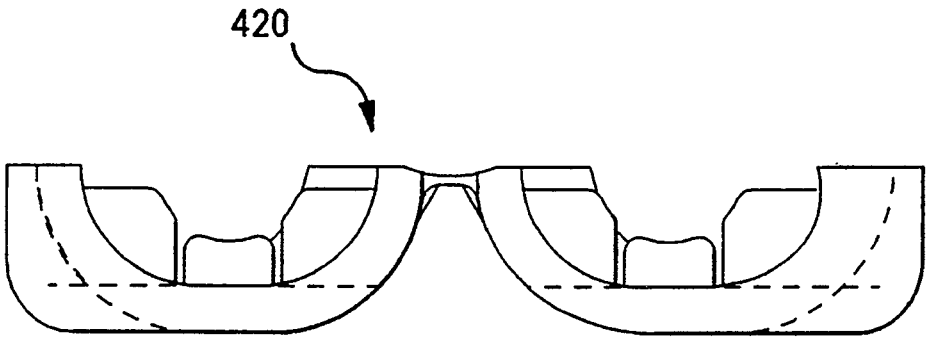
FIG. 32 shows an end view of the cable support member of FIG. 30.
Figure 33:
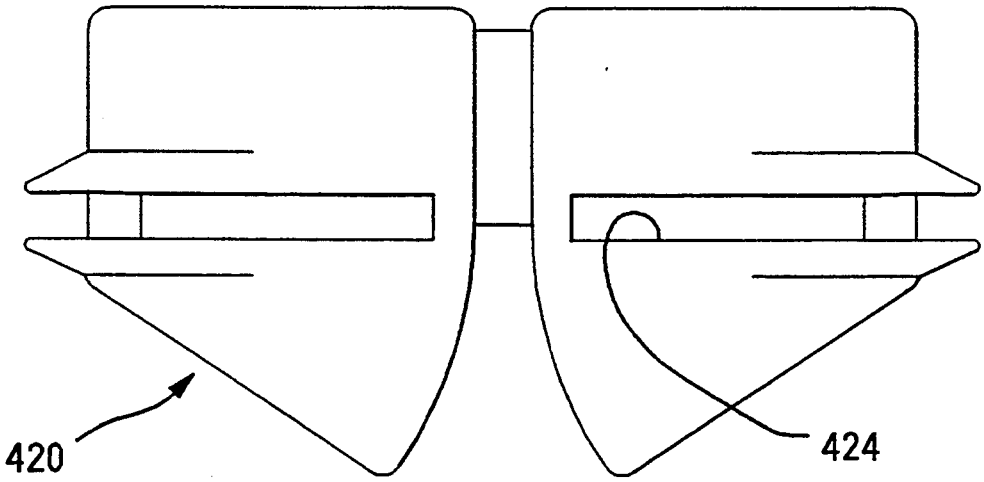
FIG. 33 shows an outer plan view of the cable support member of FIG. 30.
Figure 34:
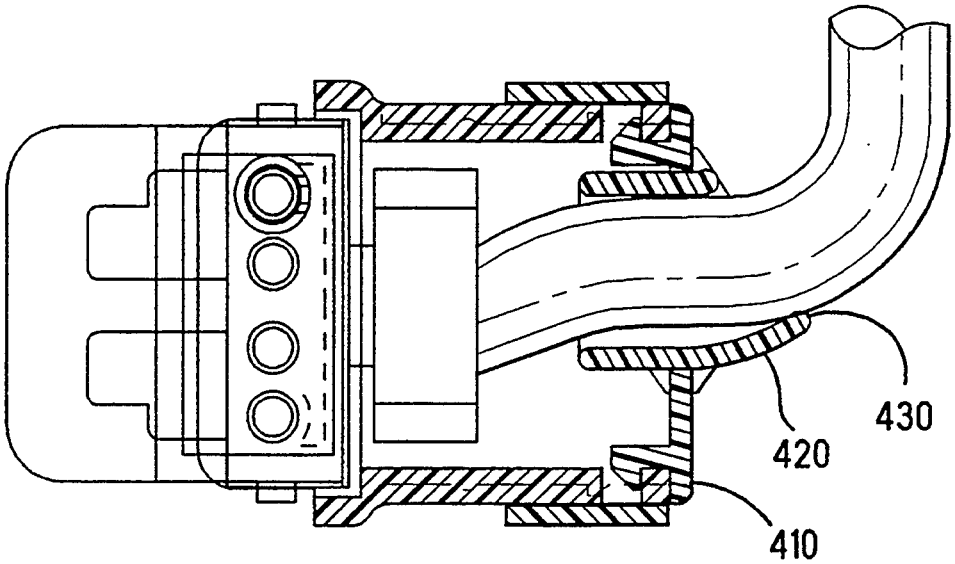
FIGS. 34 and 35 show the various cable exiting positions useable with the rear support plate and cable sleeve of FIGS. 26–33.
Figure 35:
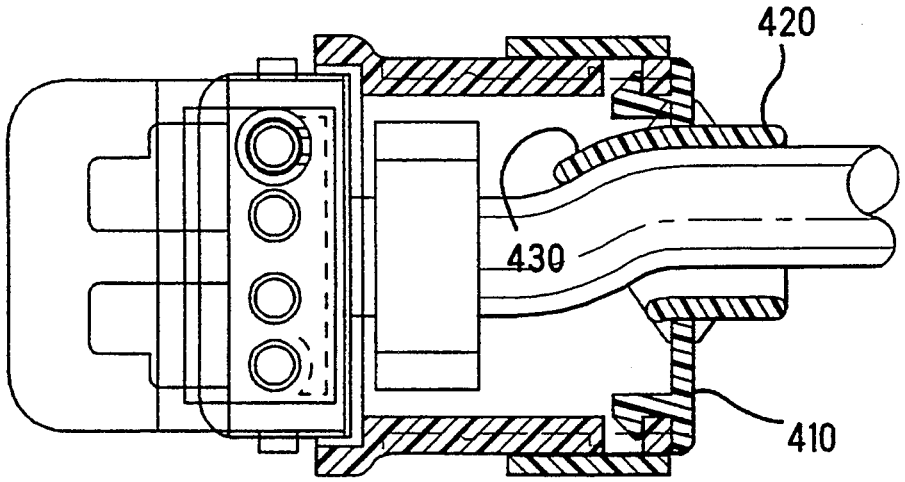

A further embodiment yet is shown yet in FIGS. 26–35. FIG. 26 shows a rear support plate 410, having an opening 412 and latches 414. A cable support clamp is shown in FIGS. 30–33 as 420 having bipartite halves 422 with a groove 424. The cable clamp 420 can be folded around and slid into the open end 412, and the plate 410 can be snap latched into place within the housing as shown in FIGS. 34 and 35.

As shown in FIGS. 34 and 35, the cable clamp 420 can be flipped end for end, to provide two cable orientations. As shown in FIG. 34 the arcuate portion 430 is shown extending out of the housing, which provides for an angled cable exit. As shown in FIG. 35, the cable clamp 420 is flipped end for end to position the arcuate portion inside the housing, and the cable exits in a straight manner.

Thus, all of the above mentioned embodiments provide a low cost data connector having more than one cable orientation, and advantageously do not require redundant parts to accomplish this objective.

We claim:

1. An electrical data connector for electrical connection to a data cable comprising an inner terminal support housing having a plurality of side by side terminals disposed therein, said inner terminal support housing having an outer insulating housing at least partially surrounding therewith, said connector being characterized in that:

said outer insulating housing has a rear opening at least as large as said inner terminal support housing for receiving said terminal support housing therein, and a cable support assembly slidable over said data cable and slidable relative to said outer insulating housing and snap latchable thereto to support said cable.

2. The data connector of claim 1, characterized in that stop means are cooperably provided by said outer insulating housing and inner housing.

3. The data connector of claim 1, characterized in that said cable support assembly is comprised of a rear support plate latchable to said outer housing, and a cable support sleeve which is fixed to said rear support plate.

4. The data connector of claim 3 characterized in that said rear support plate is bipartite, and can be assembled over said data cable.

5. The data connector of claim 4, characterized in that said rear support plate is a unitary piece molded together via a web of material.

6. The data connector of claim 3, characterized in that said support plate has a plurality of fixed orientations to said housing thereby providing a plurality of cable exiting orientations.

7. The data connector of claim 3, characterized in that both of said cable support sleeve and said support plate have a plurality of fixed orientations to said housing thereby providing a plurality of cable exiting orientations.

8. The data connector of claim 3, characterized in that said support plate is a unitary piece, with a side opening for receiving a cable support sleeve.

9. The data connector of claim 3, characterized in that said rear support plate has an opening therethrough having support members flanking said opening, where said support members impinge upon said cable support sleeve to retain said cable support sleeve thereto.

10. The data connector of claim 9, characterized in that said cable support sleeve has at least one outer groove in an outer surface thereof which is receivable in said opening against said support members to retain said sleeve thereto.

11. The data connector of claim 3, characterized in that said cable support sleeve, has a plurality of fixed orientations to said housing thereby providing a plurality of cable exiting orientations.

12. An electrical data connector for electrical connection to data cable, comprising a plurality of electrical terminals positioned in an insulating housing, said housing means having at least one cable exit opening therethrough, and a cable support sleeve fixable to said housing and within said opening for retaining said data cable, said connector being characterized in that said cable support sleeve can be fixed in said cable exit opening in a plurality of orientations, thereby providing a plurality of cable exiting directions, and said housing includes a rear support plate releasably fixable to said housing means, where said opening is positioned in said rear plate.

13. The connector of claim 12, characterized in that said rear support plate can be assembled to said housing, over the cable.

14. The data connector of claim 3, characterized in that the support plate is comprised of two identical members which are locked together.

15. The connector of claim 12, characterized in that said rear support plate has support edges spanning said opening, and said cable support member has a plurality of grooves which are gripped by said edges, to hold said cable support sleeve in a plurality of orientations.

16. The cable support sleeve of claim 12, characterized in that said cable support sleeve has a cable exit opening which, when rotated into various orientations, moves said cable into various exit directions.

17. The cable support sleeve of claim 12, characterized in that said cable support sleeve has inner surfaces for directing said cable outwardly in either an angled or a straight direction.

18. An electrical connector having an insulating housing carrying a plurality of electrical terminals, where said terminals include a contact portion and a wire termination portion, said wire termination portion comprising a slot within a metal plate member for insulation piercing electrical connection with an insulated wire, and a stuffer cap for receiving the insulated wire, said cap being insertable over said wire termination portion for electrically connecting said wire to said terminal, said connector being characterized in that said stuffer cap has a rear wall having a plurality of openings therethrough, which redirect said wires at an angle towards said longitudinal centerline.

19. The connector of claim 18, wherein said openings are positioned in angled walls which are facing said longitudinal centerline.

20. The connector of claim 18, characterized in that said connector includes four electrical terminals, where said stuffer cap has a rear wall with four individual rear plate portions along a mirror image for redirecting said wires towards said longitudinal centerline.

21. The connector of claim 18 where said wire termination portion includes a cylindrical barrel and said stuffer cap includes cylindrical openings therethrough for receipt of said cylindrical barrels therein.

* * * * *